United States Patent [19]

Carnaghan et al.

[11] 4,346,953

[45] Aug. 31, 1982

[54] ANTENNA COUPLING ASSEMBLY

[75] Inventors: Luason L. Carnaghan, Norwich; Raymond J. Phillips, Oakdale, both of Conn.

[73] Assignee: The United States of America as represented by the Secretary of the Navy, Washington, D.C.

[21] Appl. No.: 139,072

[22] Filed: Apr. 10, 1980

[51] Int. Cl.[3] ..... H01R 11/00

[52] U.S. Cl. ..... 339/28; 343/719

[58] Field of Search ..... 339/10, 28, 29; 343/709, 710, 719

[56] References Cited

U.S. PATENT DOCUMENTS

| | | | |
|---|---|---|---|
| 2,067,337 | 1/1937 | Polatzek | 343/719 X |
| 3,721,939 | 3/1973 | Paugh | 339/101 X |
| 4,026,621 | 5/1977 | Korba | 339/28 X |
| 4,173,384 | 11/1979 | Phillips | 339/101 |

*Primary Examiner*—Joseph H. McGlynn
*Assistant Examiner*—Frank H. McKenzie, Jr.
*Attorney, Agent, or Firm*—Robert F. Beers; Arthur A. McGill

[57] ABSTRACT

A flexible coupling assembly for a radio antenna of a submarine buoyant cable antenna system is connected in a cable line that retains the characteristics of the cable as regards the outside diameter, flexibility tensile strength and electrical continuity. The assembly comprises flexible co-axial connectors at each end keyed to an insulator that is press fit in a transition piece. The transition piece is press fit into the tubing by barbed type annular rings machined into the transition piece. Between the insulators and enclosed by the tubing are plastic pieces connected by a coil spring.

3 Claims, 4 Drawing Figures

ANTENNA COUPLING ASSEMBLY

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention generally relates to an electrical coupling assembly and more particularly to a coupling device that enables the antenna section of an antenna assembly to be coupled to the cable section for conducting electrical signals. The coupling is to be designed in such a fashion so that the physical and electrical characteristics are essentially the same as the cable itself. The coupling must be compatible with all other components of the system as well as with all of the equipment that is common to the operation of the system.

Previous designs lacked the electrical and/or physical capability of the present invention when used in a buoyant cable antenna system for submarines. Prior art connectors included a splice conductor assembly that was heavy and would stretch under tensile loading. These drawbacks are eliminated in the present invention.

SUMMARY OF THE INVENTION

It is therefore a general object of the present invention to provide an improved electrical coupling assembly for electrical and/or electronic equipment. Another object is that the electrical coupling assembly be suitable for connecting the antenna section of an antenna assembly to the cable section while meeting specific criteria. Further objects are that the assembly be flexible but inhibit rotation. Additional objects are that the device be lighter and relatively inexpensive when compared to prior art devices. These and other objects of the invention and the various features and details of construction and operation will become apparent from the specification and drawing.

This is accomplished in accordance with the present invention by providing an electrical coupling assembly comprised of contacts, insulators, housings and bellows coupling in such a manner as to be flexible. This flexibility allows the adapter to pass through sheaves, seals, cable handling mechanism, etc. It allows the flexible coupling assembly, once installed, to remains as a flexible coupling in the cable line and retain the characteristics of the cable as regards the outside diameter, flexibility, tensile strength and electrical continuity.

DESCRIPTION OF THE PREFERRED EMBODIMENT

Figure 1:
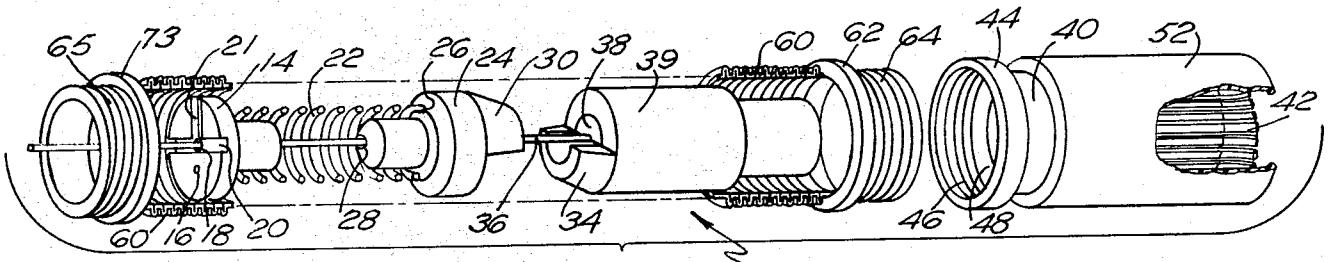
FIG. 1 PRIOR ART
FIG. 1 is a partially cutaway exploded view of a co-axial radio frequency contact connector assembly forming a portion of the antenna coupling assembly of the present invention.

Referring now to FIG. 1 there is shown an exploded view of a co-axial radio frequency connector assembly 10. This assembly 10 incorporates the design in U.S. Pat. No. 4,173,384 by a co-inventor in this application, Raymond J. Phillips.

The connector assembly 10 has a plurality of components to be described. The first of these is a spring seat 14 made of insulating material. The spring seat 14 has apertures 16 and 18, and grooves 20 and 21. The flexible spring 22 is affixed to spring seat 14 by inserting an end of the spring 22 through aperture 16. The other end of spring 22 is affixed to a spring cap 24 by passing the end through an aperture 26. The spring cap 24 is made of insulating material. It has in addition to the above a center aperture 28 and a split end 30.

An insulated socket connector 32 has a split end 34 abutting split end 30 of spring cap 24. The abutting of ends 30 and 34 prevents relative rotation between cap 24 and connector 32.

The socket connector 32 has an electrical wire 36 connected to the back end of feedthrough socket 38. The wire 36 extends through center aperture 28 of spring cap 24, the center of spring 22 and aperture 18 of spring seat 14.

Figure 2:
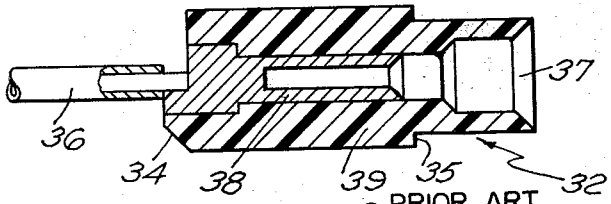
FIG. 2 PRIOR ART
FIG. 2 is a sectional view of the insulated socket connector of FIG. 1.

A sectional view of connector 32 is shown in FIG. 2. The wire 36 is soldered to the feedthrough socket 38. The socket 38 is encapsulated in an insulating material 39 along its length. The insulation 39 has a wall 35 orthogonal to the connector 32 axis and an aperture 37 at the end opposite wire 36.

Referring again to FIG. 1, a metallic contact ring 40 forms part of an outer conductor. The contact ring 40 has flexible spring fingers 42 with a ferrule 44 at the opposite end. The ferrule 44 has interior threads 46 and a collar 48. The collar 48 in assembly abuts wall 35 of connector 32. An insulator sleeve 52 fits over spring fingers 42 and abuts ferrule 44.

A flexible bellows 60 forms a part of the outer conductor. It has at one end a ring 62 with screw threads 64 and at the other end a ring 73 with screw threads 65. The screw threads 64 mate with threads 46 of contact ring 40.

Figure 3:
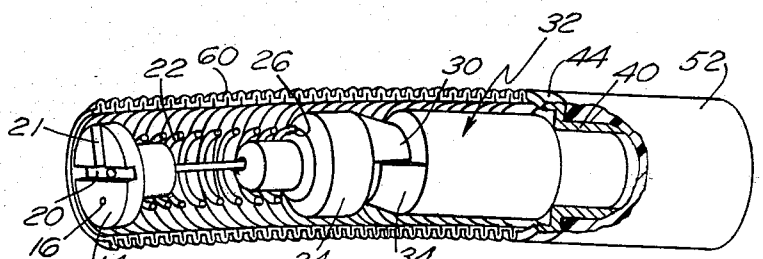
FIG. 3 PRIOR ART
FIG. 3 is a partially cutaway perspective view of the contact connector assembly of FIG. 1.

Referring now to FIG. 3 there is shown the flexibility of contact connector assembly 10 due to the action of spring 22 and bellows 60. Rotation of components is limited due to the ends of spring 22 being inserted in apertures 16 and 26, and mating notches of split ends 30 and 34. The bellows 60 provides a fixed length electrical path which remains the same during flexing, tension and compression. In addition, the bellows 60 and spring 22 allow for a design whereby these parts are under a pre-determined amount of compression when assembled and in use. This aids in the continuation of correct contact engagement while the cable is under tension and some elongation of the associated parts occurs.

In use a mating connector that is not shown, has a pin inserted and fully seated in socket 38. The flexible spring partly compresses as the outer contact spring fingers 42 become fully engaged. This allows for more tolerance in assembly and also insures continued engagement of the contacts notwithstanding adverse tension flexing during handling or in use.

Figure 4:
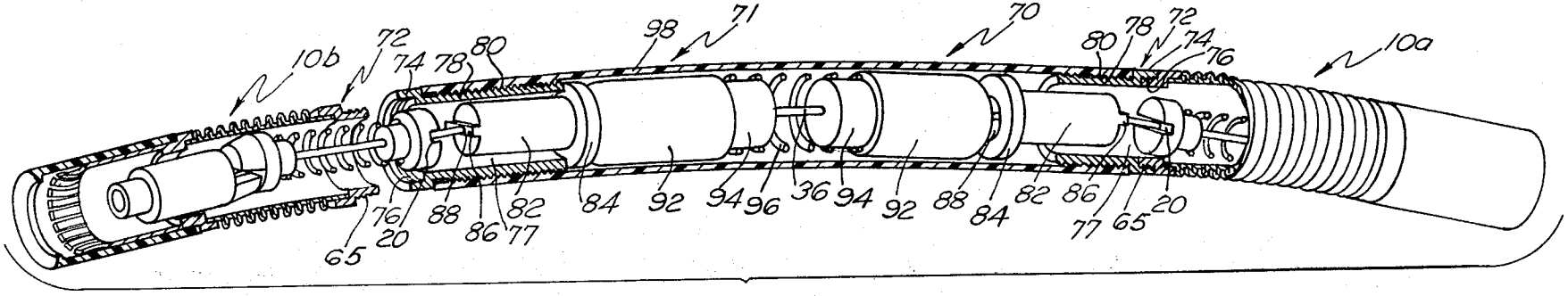
FIG. 4 is a partially cutaway exploded view of the antenna coupling assembly of the present invention.

Referring now to FIG. 4 there is shown the antenna coupling assembly 70 of the present invention. Assembly 70 is suitable for mating with the cable assembly of U.S. Pat. No. 4,173,384 and is an interchangeable replacement for the chassis in the patent. When in use assembly 70 is normally enclosed inside the watertight flexible tube and housing of U.S. Pat. No. 4,166,921.

The antenna coupling assembly 70 has at its ends connector assemblies 10*a* and 10*b*. Assembly 10*b* differs from assembly 10*a* only in that a pin replaces a socket in connector 32. Both assemblies 10*a* and 10*b* differ from assembly 10 in that a non-essential groove 21 is omitted.

The adapter assembly 71 of antenna coupling assembly 70 comprises an adapter 72 that mates with connector assemblies 10*a* and 10*b*. The adapter 72 has on each end a sleeved collar 74 having inner threads 76 that mate with the threads 65 of connectors assemblies 10*a* and 10*b*. An aperture 77 extends through the central axis of collar 74. A sleeve 78 of collar 74 has outer barbed type annular rings 80 machined into it. A cylindrical plastic support piece is press fit into aperture 77. At one end of piece 82 there is a circular head 84 for abutting the sleeve 78 of the collar 74. The other end of piece 82 has a split extension 86 for fitting in groove 20. This prevents rotation of the mating components. An aperture 88 extends through the axial center of cylindrical piece 82. Circular head 84 abuts with an end of spring support 92. The other end 94 of spring support 92 has a spring 96 coiled around it. A watertight polyvinyl chloride sleeve 98 is wrapped around each of the two annular rings 80 and encloses the intermediate components. The center conductor wire 36 is at the axial center of every component of assembly 70.

There has therefore been described an adapter that is flexible but resists rotation over its entire length. The device is suitable for being enclosed by the flexible housing described in U.S. Pat. No. 4,166,921 by Raymond J. Phillips a co-inventor in the present case. The adapter is compatible with all components in a buoyant cable antenna system. The adapter is lighter in weight than prior devices. This is a particularly desirable feature in a buoyant cable. The device has high tensile strength giving it less tendency to stretch under tension than previous designs, thereby leaving the contacts engaged under higher tensile loading. This type adapter can be made to any length and/or diameter so as to be compatible with the system and cable with which it is used. It is not limited to R.F. type use but can be used in any current carrying capacity where two cables need to be joined and the cable characteristics including diameter and flexibility cannot be altered.

It will be understood that various changes in the details, materials, steps and arrangement of parts, which have been herein described and illustrated in order to explain the nature of the invention, may be made by those skilled in the art within the principle and scope of the invention as expressed in the appended claims.

What is claimed is:

1. A flexible adapter assembly for coupling a pair of flexible electrical connectors comprising:

an adapter at each end, with each adapter having a collar with inner threads and an extension sleeve with barbed type annular rings, said each adapter having an aperture through its axis;

a pair of cylindrical pieces with each of said pair respectively inserted in the aperture of said each adapter, said cylindrical pieces having a flange abutting respective sleeves of each adapter;

a pair of spring supports with each of said spring supports having one end abutting respective cylindrical pieces;

a spring abutting and coiled around each of said spring supports; and a watertight sleeve enclosing said adapter extension sleeves, said cylindrical pieces, said spring supports and said spring.

2. An antenna coupling assembly comprising:

a flexible adapter assembly comprising an adapter at each end, with each adapter having a collar with inner threads and an extension sleeve with barbed type annular rings, said each adapter having an aperture through its axis, a pair of cylindrical pieces with each of said pair respectively inserted in the aperture of said each adapter, said cylindrical pieces having a flange abutting respective sleeves of each adapter, a pair of spring supports with each of said spring supports having one end abutting respective cylindrical pieces, a spring abutting and coiled around each of said spring supports, and a watertight sleeve enclosing said adapter extension sleeves, said cylindrical pieces, said spring supports and said spring.

3. An antenna coupling assembly according to claim 3 wherein each of said first and second flexible electrical connector assemblies comprises:

an insulated electrical connector having a split end and an electrical feedthrough with said split end adapted for connecting an electrical wire and the end opposite said split end suitable for receiving an external electrical conductor;

a spring cap having a split end suitable for abutting said insulated electrical connector split end so as to prevent relative rotation between said spring cap and said insulated electrical connector, said spring cap further having a first aperture adapted for passing through said electrical wire and a second aperture;

a flexible spring having one end inserted in said second aperture of said spring cap and adapted to have said electrical wire fed axially through said spring; and a spring seat having a first aperture adapted to pass through said electrical wire and a second aperture having the other end of said flexible spring inserted therein.

* * * * *